United States Patent [19]

Munna

[11] Patent Number: 4,461,456

[45] Date of Patent: Jul. 24, 1984

[54] HYDRAULIC LEVELER RAMP

[76] Inventor: Rocco M. Munna, 42807 Sachs Dr., Lancaster, Calif. 93534

[21] Appl. No.: 498,294

[22] Filed: May 26, 1983

[51] Int. Cl.[3] ..... E02C 3/00

[52] U.S. Cl. ..... 254/88; 254/93 H

[58] Field of Search ..... 254/88, 93 H, 8 B

[56] References Cited

U.S. PATENT DOCUMENTS

| | | | |
|---|---|---|---|
| 1,447,242 | 3/1923 | Fritz | 254/93 H |
| 2,076,069 | 4/1937 | Davis | 254/88 |
| 4,289,299 | 9/1981 | Kameda | 254/8 B |

FOREIGN PATENT DOCUMENTS

| | | | |
|---|---|---|---|
| 2255970 | 5/1974 | Fed. Rep. of Germany | 254/93 H |
| 331855 | 7/1930 | United Kingdom | 254/88 |
| 1034571 | 6/1966 | United Kingdom | 254/88 |
| 1248261 | 9/1971 | United Kingdom | 254/8 B |
| 2034408 | 6/1980 | United Kingdom | 254/8 B |

*Primary Examiner*—Robert C. Watson

*Attorney, Agent, or Firm*—Francis X. LoJacono

[57] ABSTRACT

A leveling device for recreational vehicles such as campers, trailers and the like, wherein the device is positioned under a wheel of the particular vehicle so as to level the vehicle to a horizontal plane while it is parked. The device is formed having a base structure defining a recess to receive a support-platform structure and a hydraulic jack when the device is in a collapsed storage mode. The base structure includes an inclined ramp whereby the wheel of the vehicle is allowed to be positioned on the support platform, so as to be raised by the jack to the proper height in order to level the vehicle. The device includes a safety locking mechanism whereby the platform is prevented from collapsing if the jack malfunctions.

6 Claims, 6 Drawing Figures

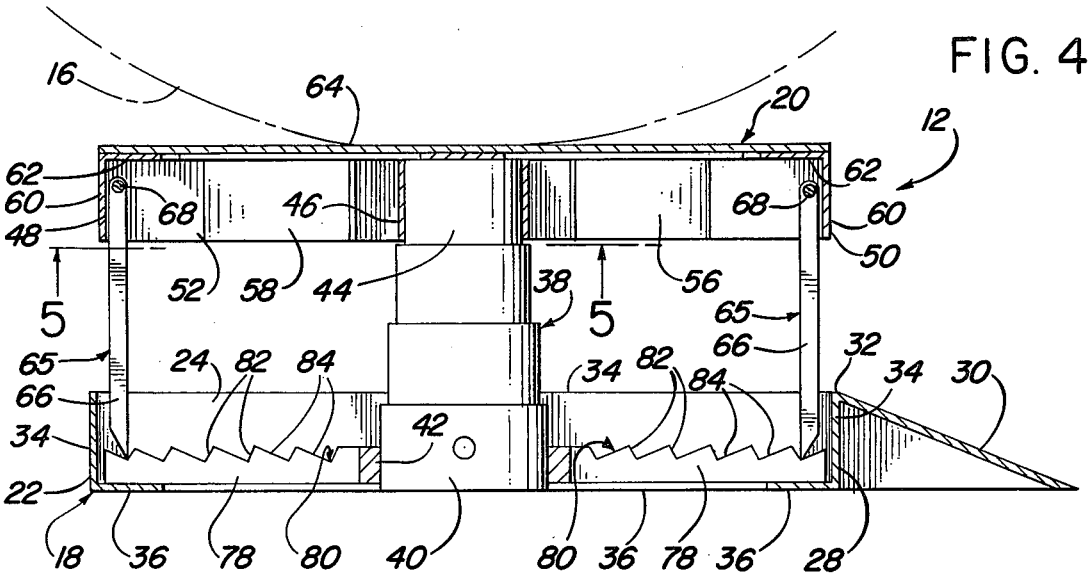
FIG. 4
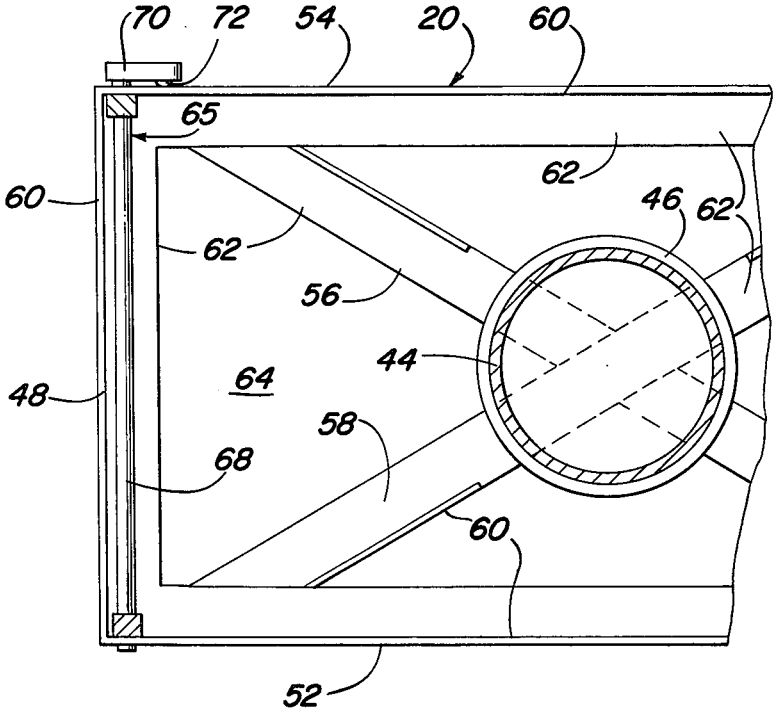
FIG. 5
FIG. 6
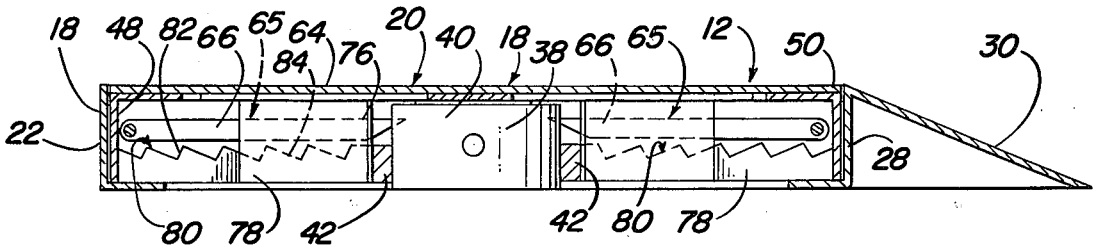

HYDRAULIC LEVELER RAMP

BACKGROUND OF THE INVENTION

1. Field of the Invention

This invention relates generaly to a vehicle jack device, and more particularly to a leveling device for parked vehicles including campers, trailers and the like that must be situated in a level horizontal plane when employed as living quarters.

2. Description of the Prior Art

It is well known in the art that various problems and difficulties exist in attempting to provide suitable means for leveling vehicles of the recreational type that are so widely in use at the present time.

Many types of leveling devices are employed for the purpose of leveling vehicles that are parked on uneven surfaces in order to establish a horizontal plane. However, these devices have features that very often restrict their use, and are complicated to operate and maintain. Some devices have been improvised that are very dangerous to use, resulting in injuries to individuals as well as damage to the vehicles.

Known leveling devices are disclosed in the following patents:

U.S. Pat. No. 4,165,862 discloses a leveling device for camper trailers and like vehicles which comprises an assembly of vertically stacked slabs, wherein one or more are adapted to be positioned beneath the lower wheel of a camper trailer or other vehicle to be leveled. The slabs are separably connected to provide a portable unitary kit; and at one end of the kit each slab is tapered from its upper to its bottom surface, and the tapered surfaces of all of the stacked slabs form an inclined ramp.

A leveling unit for parked vehicles is disclosed in U.S. Pat. No. 4,108,421 which includes a horizontal stand having a manual vertically adjustable wheel-support ramp, with a wheel-engaging surface and ground-engaging means under the stand.

U.S. Pat. No. 3,994,474 discloses a device for lifting vehicles which is formed having a rectangular bottom frame that includes a lifting platform which is hinged by a parallelogram-guiding linkage to move vertically above the bottom frame. An air bellows is fitted between the lifting platform and the bottom platform. The device travels on wheels which pass into the bottom platform as the bottom platform is urged to the ground under the weight of the vehicle.

Other types of related devices can be found in U.S. Pat. No. 3,174,722 for a LOAD LIFTING DEVICE, and U.S. Pat. No. 2,200,994 for a VEHICLE JACK.

SUMMARY OF THE INVENTION

The present invention is a leveling device for parked campers, house trailers, and other recreational vehicles, as well as mobile homes, an important object being to overcome the inherent problems associated with existing leveling devices.

It is another object of the invention to provide a leveling device for parked vehicles that is formed having a base structure defining a recessed housing adapted to receive a support platform which is operably moved to a raised position by a hydraulic jack mounted between the base structure and the platform. The base structure includes a ramp whereby the particular vehicle wheel is allowed to be positioned on the platform in a stored or collapsed mode. Once it is positioned centrally on the platform, the wheel is raised to establish a horizontal level for the vehicle. As the platform rises, a plurality of safety support bars automatically adjust to the selected position of the platform, so as to lock the platform in place while the vehicle is parked.

It is still another object of the invention to provide a leveling device of this character that is easily adjustable to any type of recreational vehicle.

Still another object of the invention is to provide a leveling device for parked recreational-type vehicles that is constructed with relatively few operating parts, and is of such a size when in a closed mode that it is readily storable in a very small space.

Still a further object of the present invention is to provide a leveling device of this type that is relatively inexpensive to manufacture, and is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Referring more particularly to the accompanying drawings, which are for illustrative purposes only:

FIG. 4 is a longitudinal cross-sectional view of the invention shown in a raised view similar to FIG. 3;

FIG. 5 is an enlarged cross-sectional view taken substantially along line 5—5 of FIG. 4; and FIG. 6 is a longitudinal cross-sectional view of the device in a collapsed position for storage.

DESCRIPTION OF THE PREFERRED EMBODIMENT

Figure 1:
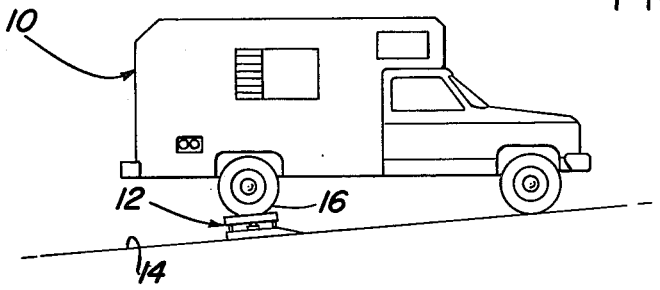
FIG. 1 is a side-elevational view of a recreational vehicle being horizontally supported by the present invention on an inclined surface.
Figure 2:
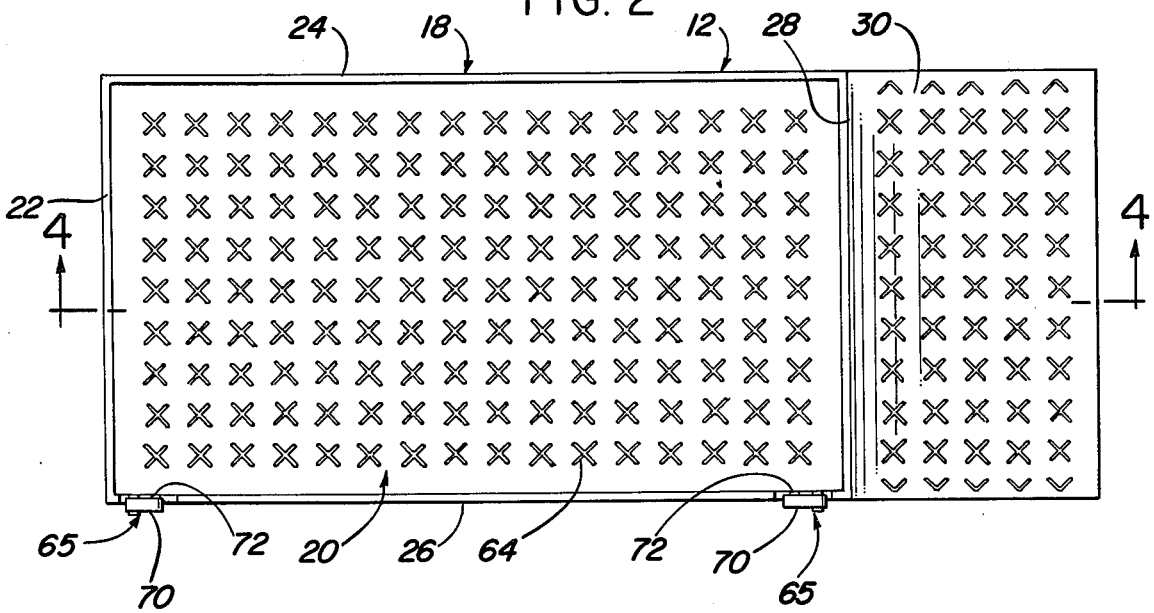
FIG. 2 is a top-plan view of the leveling device.

Referring more particularly to FIG. 1, there is shown a recreational vehicle, generally indicated at 10, which represents various types of vehicles that are usually required to be horizontally leveled when parked in order to render them suitable as living quarters. It should be noted that the present invention is also compatible for use with campers, house trailers, mobile homes, etc., which are required to be parked in a level horizontal position.

The present invention, a leveling device designated at 12, is shown in FIG. 1 as being supported on an inclined surface 14 and mounted under one of the rear wheels 16. Leveling device 12, however, is adjustable (as will be understood from the following description) to be positioned when required under any one or more wheels of the vehicle in order to establish a horizontal plane while parked.

Leveling device 12 comprises a base structure 18 which defines a frame-like housing adapted to receive support-platform structure 20 therein when in a collapsed storage mode, as illustrated in FIG. 6. The frame housing is formed by a plurality of angle-iron members which include a rear member 22, side members 24 and 26, and a front member 28. Front member 28 is provided with an inclined ramp portion 30, the ramp being inclined both upwardly and rearwardly so as to be flush with the top leading edge 32 of front angle member 28. Thus, each angle member is formed having a vertical wall 34 and a flat bottom wall 36.

Figure 3:
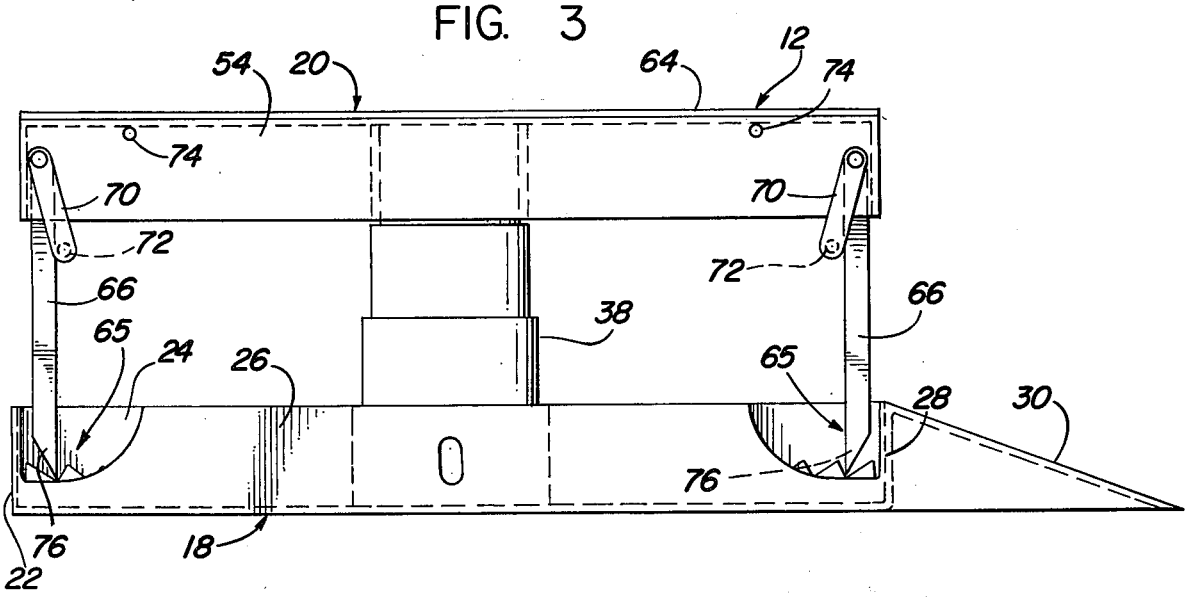
FIG. 3 is an enlarged side-elevational view of the device in a fully raised mode.

Centrally positioned within the base structure is means for securing and mounting a hydraulic-jack device, generally indicated at 38. This device can be any suitable known pancake-type jack that is readily collapsible so as to be received between the base structure and the support-platform structure 20, as illustrated in FIGS. 3 and 4 in a fully raised mode of operation, and in FIG. 6 in a fully collapsed mode.

Hydraulic jack 38 is typically provided with a plurality of telescoping cylinders, the largest lower cylinder 40 being attached to the base structure 12 by truss members 42. The uppermost cylinder 44 is secured in mounting ring 46, which itself is attached to the underside of support-platform structure 18.

Support platform 18 comprises a frame structure which includes a plurality of angle members similar to those of the base structure. That is, there are provided a rear angle member 48, a front angle member 50 and two side members 52 and 54, with two additional cross-brace angle members 56 and 58. The cross-brace members are positioned so as to provide a mounting structure for ring 46. Again, each angle member includes a vertical side wall 60 and a flat horizontal wall 62. Suitably secured to the respective angle members 48, 50, 52, 54, 56 and 58 is a flat support sheet 64, preferably of steel or the like. This sheet provides a flat landing on which the vehicle wheel rests when it is raised, as seen in FIGS. 1 and 4.

The present leveling device further includes a safety means 65 to prevent accidental collapse of the platform, if the jack should unexpectedly fail. Safety means 65 comprises a plurality of bars or legs 66, the leg members being pivotally mounted adjacent each corner of the support platform. Legs 66 are interconnected in pairs by rods 68, whereby a set of legs at one end of the platform will rotate together as a pair, while a second set of legs at the opposite end will rotate together as a pair. Accordingly, as the platform is raised, each pair of bar or leg members will rotate from a folded position, as seen in FIG. 6, to an extended locked position, as seen in FIGS. 3 and 4. Each pair of locked-leg members include latching means that allows the respective legs to be latched in a stored horizontal position, as illustrated in FIG. 6.

The latch means comprises a latch arm 70 which includes spring-loaded latch pin 72 that is adapted to be received in detent 74 formed in the surface of depending wall 60, as indicated in FIG. 3. Each latch arm 70 is affixed to its respective rod 68, whereby the latch arm will rotate with the rod when latch pin 72 is manually disengaged from detent 74. The free end 76 of each leg member is tapered to a point so as to be readily adapted for locking along a locking bar 78. Each locking bar is located along the inner longitudinal angle members 24 and 26, so as to be directly engageable by the respective locking leg 66. Thus, there are four locking-bar members 78, one for each respective leg 66, the locking bars being formed having a plurality of notches 80, and each notch being provided with an engaging face member 82 and an inclined surface 84. When platform 20 is raised, legs 66 are allowed to freely rotate downwardly by their own weight. This allows the pointed or wedge-shaped free end 76 to be received progressively into each contiguous notch 80. Hence, the leg members will lock in one of the notches when the vehicle is positioned in a level horizontal plane.

In order to release the locking leg members 66, the jack is raised just enough to free both sets of legs from the respective notches 80. The legs are then manually rotated upwardly and are latched by latching pin 72 into a horizontal position within the framework of the platform structure. The platform is then lowered so as to be received in a closed collapsed mode, as seen in FIG. 6.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A leveling device for parked vehicles, comprising:

a base structure adapted to be positioned on a fixed surface, said base structure formed having a recessed storage area therein;

a platform structure adapted to support a wheel of a vehicle to be raised by said platform, said platform being arranged to be received in said recess of said base structure in a substantially flat compact manner, so as to allow for a closed collapsible mode when said vehicle is to be positioned thereon prior to raising said platform;

a lift means interposed between said base and said platform structure, whereby said platform structure is allowed to be selectively raised to a height wherein said vehicle is leveled to a horizontal position;

a ramp member mounted at one end of said base structure and formed as an integral part thereof, whereby said wheel is allowed to pass thereover and rest on said platform;

locking means mounted between said base structure and said platform structure to prevent said platform structure from accidentally collapsing when in a raised mode;

wherein said locking means comprises:

a first set of locking-leg members positioned adjacent one end of said platform structure;

a second set of locking-leg members positioned adjacent the opposite end of said platform structure, each of said first and second sets of locking-leg members including a pair of locking-leg members that are interconnected by a rod, whereby said legs of said set rotate together with said rod;

latching means attached to said rods of said sets, whereby said locking legs are latched in a closed position when not in use, said latching means adapted to be manually operated to a released position so that said pairs of leg members are free to rotate downwardly together; and a plurality of locking-bar members mounted to said base member, each of said locking-bar members being positioned to engage a respective locking-leg member, as said leg members rotate downwardly when said platform is raised.

2. A leveling device as recited in claim 1, wherein each of said locking-leg members includes a free end having a wedge-shaped configuration; and wherein each of said locking-bar members is formed having a plurality of notches adapted to receive said free ends of said locking legs therein as said platform is raised.

3. A leveling device as recited in claim 2, wherein said lift means is a hydraulic jack centrally positioned within said base structure.

4. A leveling device as recited in claim 2, wherein said base structure comprises a plurality of angle members arranged to define said recess therein.

5. A leveling device as recited in claim 4, wherein said platform structure comprises:

a plurality of angle members defining a substantially rectangular framework; and a substantially flat plate member fixedly secured to the top of said rectangular framework of said platform structure.

6. A leveling device as recited in claim 5, wherein said latching means comprises:

a latch-arm secured at one end of said rod so as to rotate therewith;

a spring-loaded latch pin mounted in said latch arm; and a detent formed in said platform and positioned therein to receive said spring-loaded latch pin when said leg members are raised to a latching position.

* * * * *